United States Patent [19]

Arentsen

[11] Patent Number: 4,601,349

[45] Date of Patent: Jul. 22, 1986

[54] HYDRAULIC PILE DRIVER

[75] Inventor: Dik Arentsen, Leiderdorp, Netherlands

[73] Assignee: IHC Holland NV, Netherlands

[21] Appl. No.: 497,730

[22] Filed: May 24, 1983

[30] Foreign Application Priority Data

Feb. 6, 1982 [NL] Netherlands ..... 8202224

[51] Int. Cl.[4] ..... B25D 9/00

[52] U.S. Cl. ..... 173/116; 173/119; 173/134; 91/165

[58] Field of Search ..... 173/116, 128, 133–136, 173/13–17, 138, 139, 119; 91/165, 166, 245; 92/60.5, 134

[56] References Cited

U.S. PATENT DOCUMENTS

| | | | |
|---|---|---|---|
| 3,049,097 | 8/1962 | Kershaw | 173/134 |
| 3,200,893 | 8/1965 | Leavell | 173/135 |
| 3,456,741 | 7/1969 | James | 173/119 |
| 3,583,499 | 6/1971 | Cordes | 173/91 X |
| 4,187,917 | 2/1980 | Bouyoucos | 173/116 X |
| 4,367,800 | 1/1983 | Arentsen | 173/127 |

*Primary Examiner*—Donald R. Schran
*Assistant Examiner*—James L. Wolfe
*Attorney, Agent, or Firm*—Kane, Dalsimer, Kane, Sullivan and Kurucz

[57] ABSTRACT

A hydraulic pile driver including a housing having an impact weight mounted therein for reciprocating movement, the impact weight being fastened to a piston movable in a cylinder, a supply source for liquid under pressure, a supply conduit communicating with the supply source, a liquid discharge conduit, a control valve for alternatively connecting the supply and discharge conduits to a cylinder chamber at one side of the piston, whereby the piston can be moved by the liquid under pressure in a direction opposite to the direction of movement of the impact weight during the work stroke, the cylinder chamber during the work stroke of the impact weight being connected to the liquid discharge conduit. The piston at the side remote from the cylinder chamber is loaded by a second pressure medium, the overpressure of the second pressure medium being low with respect to the liquid pressure in the cylinder chamber prior to the working stroke, the overpressure being independent of the liquid pressure.

5 Claims, 6 Drawing Figures

HYDRAULIC PILE DRIVER

BACKGROUND OF THE INVENTION

The invention relates to a hydraulic pile driver including a housing having an impact weight mounted therein for reciprocating movement, said impact weight being fastened to a piston movable in a cylinder, a supply source for liquid under pressure, a supply conduit communicating with said supply source, a liquid discharge conduit, means for alternatively connecting the said supply and discharge conduits to a cylinder chamber at one side of the piston, whereby said piston can be moved by the liquid under pressure in a direction opposite to the direction of movement of the impact weight during the work stroke, the said cylinder chamber during the work stroke of the impact weight being connected to the liquid discharge conduit.

Known embodiments of such hydraulic pile drivers have the disadvantage that when a pile or the like is driven into the ground under an acute angle with the horizontal plane, the maximum impact energy will considerably decrease due to decrease of the acceleration force on the impact weight and an increase of the occurring frictional forces. In practice, the known pile drivers therefore are not capable of driving under a small angle with the horizontal plane, for example under an angle $<30°$, or of driving horizontally, though the latter operation would be often desirable for driving ground anchors, for example.

SUMMARY OF THE INVENTION

The present invention has the object of providing a hydraulic pile driver, which is extremely well suited for driving under a small angle with the horizontal plane or driving horizontally.

For this purpose the hydraulic pile driver of the invention is characterized in that the piston at the side remote from the said cylinder chamber is loaded by a second pressure medium, the overpressure of said second pressure medium being low with respect to the liquid pressure in the said cylinder chamber prior to the working stroke, said overpressure being independent of said liquid pressure.

According to the invention an additional acceleration force is created on the impact weight, this force being independent of the pressure of the liquid under pressure. Thereby the hydraulic pile driver of the invention also will be capable to drive under small angles with the horizontal plane or to drive horizontally, respectively.

In this connection it is observed that it has already been proposed to load the piston at the side remote from the said cylinder chamber by a fraction of the liquid pressure. However, the liquid, when the pile driver should work horizontally or nearly horizontally, will be hardly pressurized, since in this case for moving the impact weight in the direction opposite to the direction of movement of the impact weight during the work stroke, the liquid will experience only a small opposing force. In accordance with the invention the pressure of the second pressure medium on the contrary is completely independent of the pressure of the liquid under pressure and the second pressure medium therefore in any pile driving direction will apply the required force on the impact weight, which force will be practically constant throughout the entire stroke length.

Preferably the second pressure medium is a gas under pressure.

BRIEF DESCRIPTION OF THE DRAWINGS

The invention will hereinafter be explained by way of the drawings, showing a number of embodiments examplifying the hydraulic pile driver of the invention.

DESCRIPTION OF A PREFERRED EMBODIMENT

Figure 1:
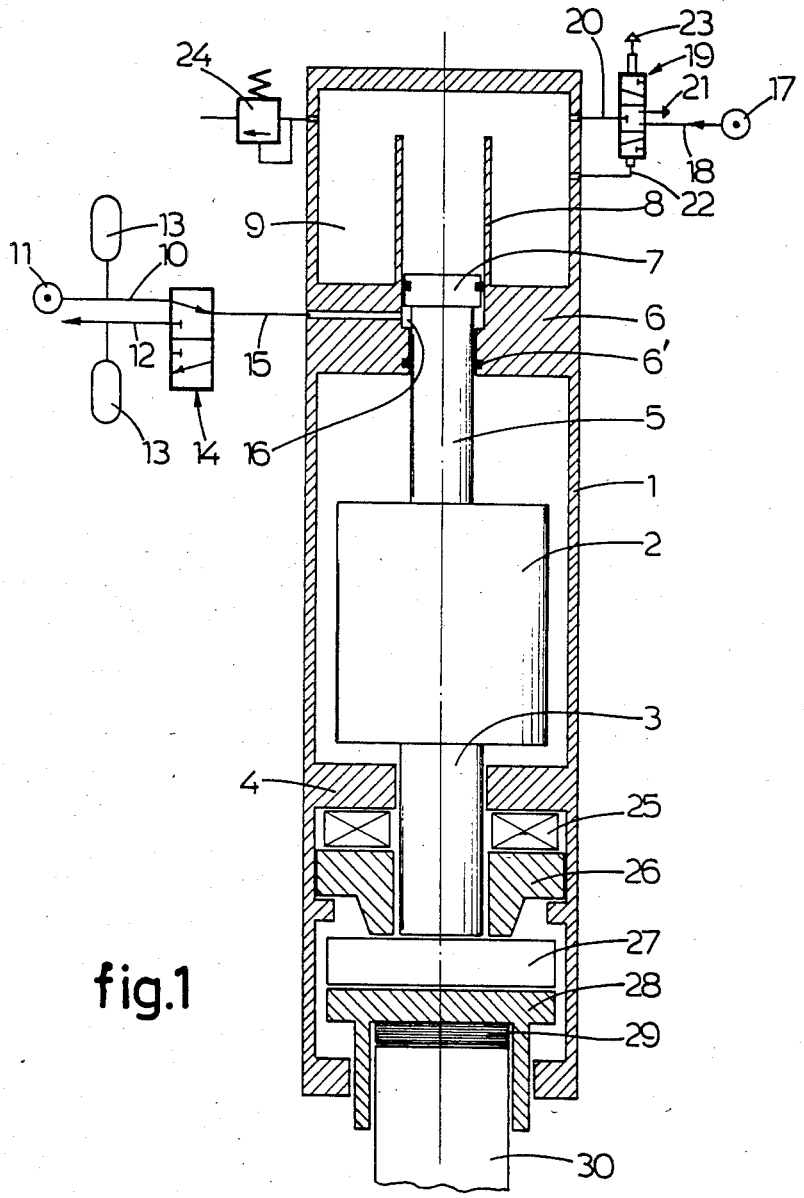
FIG. 1 is longitudinal section of a first embodiment of a pile driver of the invention.

FIG. 1 shows a first embodiment of the pile driver of the invention. This pile driver is mainly used for driving steel, concrete or wooden piles or profiles into the ground.

The pile driver includes a housing 1 in which an impact weight 2 is guided for sliding up and down. For this purpose this impact weight 2 is provided with a lower guide rod 3, traversing a lower guide ring 4 in the housing 1 and an upper guide rod 5 which is passed through an upper guide ring 6 in the housing 1 and terminates in a piston 7, the guide ring 6 including a sealing 6'.

This piston 7 is sealingly movable in a cylinder 8, which, in the embodiments of FIGS. 1–4, is open at the upper side and communicates with a chamber 9, surrounding this cylinder 8.

A supply conduit 10 in which an accumulator 13 is included, is connected to a supply source 11 for a liquid under high pressure (for example 200–300 bar). A discharge conduit 12 also includes an accumulator 13. The supply conduit 10 and the discharge conduit 12 are connected to a cylinder chamber 16 under the piston 7 by way of a control slide valve 14 and a conduit 15.

In the position of the control slide valve 14 illustrated in the drawing, the supply conduit 10 is connected with the conduit 15 and the piston 7 is loaded upwardly by the liquid under high pressure for lifting the impact weight 2.

When the control slide valve 14 is moved to the position connecting the conduit 15 with the liquid discharge conduit 12 the impact weight 2 effects its work stroke.

According to the invention the piston 7 at the upper side is continuously loaded by a second pressure medium, which in the embodiments of FIGS. 1–4 is a gas, preferably an inert gas, like nitrogen, under pressure. When pile driving under water usually air under pressure will be used as the second pressure medium. The pressure of this second pressure medium is for example about 10–20 bar, and therefore low with respect to the pressure of the liquid under high pressure in the cylinder chamber 16 prior to the work stroke.

In the embodiments according to FIGS. 1–4 the cylinder 8 above the piston 7, as well as the chamber 9 in the housing 1, surrounding the cylinder 8, are filled with the second pressure medium.

Since the chamber 9 is large with respect to the swept volume of the piston 7, the pressure of the second pressure medium in operation will not show great variations, which is important for applying an acceleration force as constant as possible on the impact weight 2.

Figure 2:
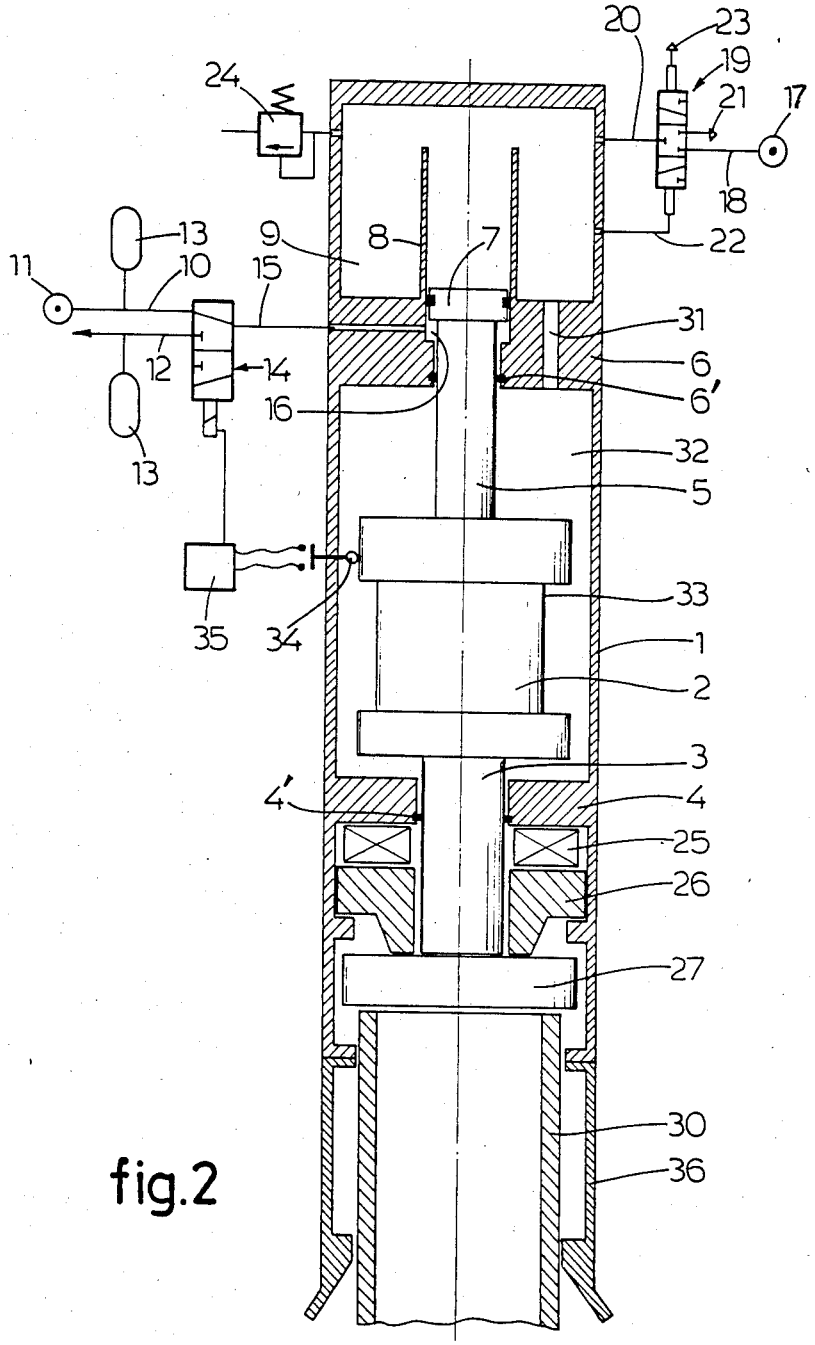
FIG. 2 is a longitudinal section of a second embodiment of the pile driver of the invention.
Figure 4:
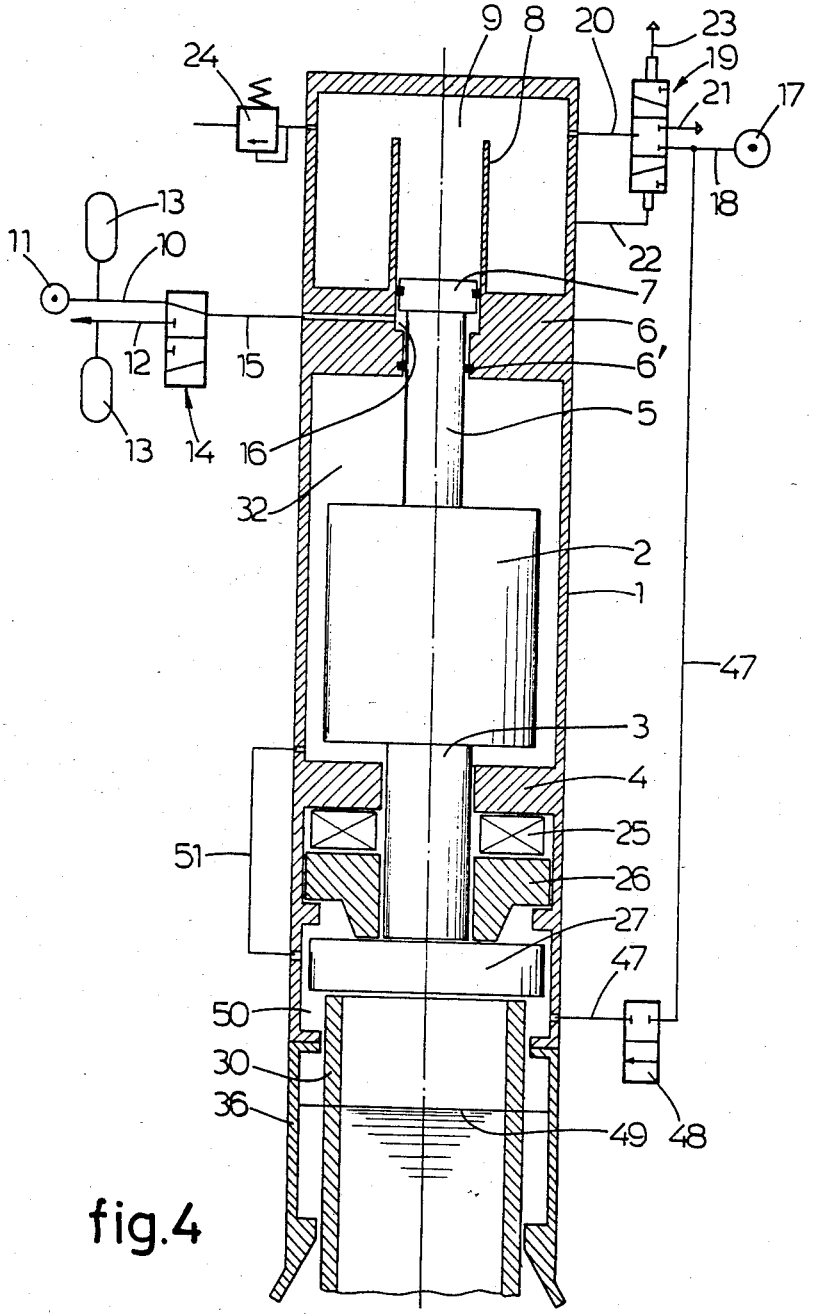
FIG. 4 is a longitudinal section of a fourth embodiment of the pile driver of the invention.

In order to permit varying the pressure of the second pressure medium in the chamber 9 in the housing 1, in the embodiments of FIGS. 1, 2 and 4, a supply source 17 for the second pressure medium is connected to the chamber 9 by way of a supply conduit 18, a control slide valve 19 having a neutral intermediate position and a conduit 20. This control slide 19 furthermore is connected to a discharge conduit 21.

By the actuation of the control slide valve 19 pressure medium can be supplied to the chamber 9 in the housing 1 and discharged from this chamber 9, respectively, whereby the pressure of the second pressure medium may be adjusted.

For controlling the control slide valve 19 this valve also is connected to the chamber 9 in the housing 1 by way of a control conduit 22, while furthermore a second control conduit 23 communicates with the environment.

As an alternative the control slide valve 19 for controlling the overpressure in the chamber 9, may be without the control conduit 22, 23 and may be switched by means of an actuator (not illustrated), for example an electromagnetic actuator.

Furthermore, the chamber 9 in the housing 1 may be provided with a pressure safety valve 24.

The housing 1 of the pile driver of FIG. 1 bears on the impact plate 27 through a shock absorber 25 and a retainer ring 26. This impact plate 27 bears on a pile bridge cap 28 guided in the housing 1 and supported on a pile 30 to be driven into the ground with the interposition of a soft cap filler 29, consisting of white fir wood, for example.

In operation, when the control slide valve 14 is brought into the position illustrated in FIG. 1, liquid under high pressure through the conduit 15 will be supplied to a cylinder chamber 16, whereby the piston 7 will be lifted, the upper guide rod 5 and the impact weight 2 following this upward motion.

Thereafter, by switching the control slide valve 14, the cylinder chamber 16 will be connected to the liquid discharge conduit 12, whereby the impact weight 2 under the influence of gravity, as well as under the influence of the force supplied by the second pressure medium in the cylinder 8 on the upper side of the piston 7, will be forcibly moved downwardly.

The pile driver in general will not effect less than 100 strokes per minute, for example 40–50 strokes per minute, while the stroke length generally will be greater than 1 meter.

The second pressure medium loading the upper side of the piston 7 enables the pile driver also to be used for obliquely driving, whereby the pile 30 is driven into the ground under an acute angle with the horizontal plane. By correctly adjusting the pressure of the second pressure medium in the chamber 9 in the housing 1, it is even possible to horizontally drive, for example, horizontal ground anchors.

The portion of the housing 1 surrounding the chamber 9 may be double-walled.

FIG. 2 shows a somewhat modified embodiment of the pile driver illustrated in FIG. 1. In the embodiment of FIG. 2 the chamber 9 in the housing 1 through a connecting passage 31 communicates with the chamber 32 in the housing 1, containing the impact weight 2. Thereby the volume of the second pressure medium is considerably enlarged, which is of importance for applying an acceleration force as constant as possible on the impact weight 2.

In this case not only the upper guide rod 5 by means of the sealing 6' is passed leak proof through the upper guide ring 6 in the housing 1, but the lower guide rod 3 also is sealed by means of a sealing 4' with respect to the lower guide ring 4 in the housing 1.

Furthermore in this embodiment the portion of the housing 1 surrounding the chambers 9 and 32 may be double-walled.

Furthermore in the pile driver of FIG. 2 the impact weight 2 is provided with one or more circumferential grooves 33 cooperating with a switch 34 in the housing 1, which switch delivers signals to an electronic control means 35 actuating the control slide valve 14.

The embodiment of FIG. 2 operates without a pile bridge cap and the housing 1 is provided with a lower guide device 36 for the pile 30. The impact plate 27 in this case delivers the impact energy directly to the pile 30.

Figures 3, 3A:
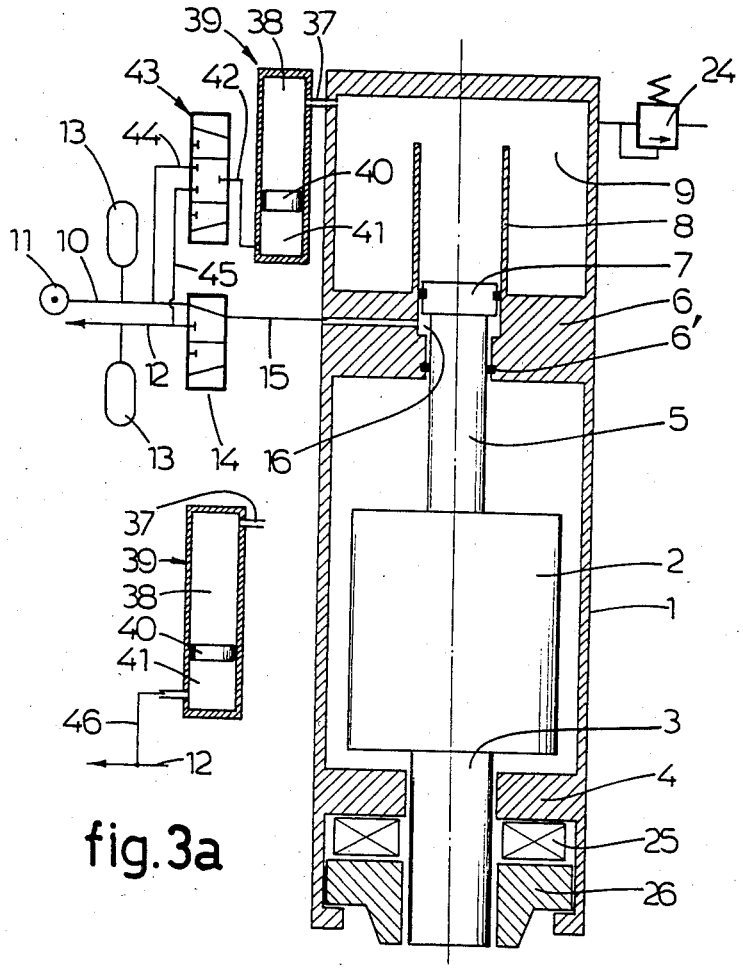
FIG. 3 is a longitudinal section of a third embodiment of the pile driver of the invention.
FIG. 3*a* shows a modified detail of the pile driver of FIG. 3 in section.

FIG. 3 shows a further embodiment of the pile driver of the invention, wherein the chamber 9 in the housing 1 via a conduit 37 communicates with a chamber 38 in an accumulator 39.

The pressure of the second pressure medium in the chambers 38 and 9, as well as in the cylinder 8, in this embodiment of the pile driver may be varied with the aid of a floating piston 40 disposed in the accumulator 39 and confining the chamber 38 at the lower side, while the chamber 41 formed under the piston 40 in the accumulator 39 via a conduit 42 and a control slide valve 43 having a neutral intermediate position will be connected in one of the positions of the control slide valve 43 by a conduit 44 to the supply conduit 10 for the liquid under pressure and will be connected in another position of the control slide valve 43 via a conduit 45 to the liquid discharge conduit 12.

In this embodiment the pressure of the second pressure medium in the chamber 9 in the housing 1 therefore may be adjusted by means of the control slide valve 43 and therefore the supply source 17 for the second pressure medium with the control slide valve 19 and further accessories may be eliminated.

FIG. 3*a* shows a somewhat modified embodiment of the pile driver of FIG. 3, wherein the chamber 41 in the accumulator 39 is connected to the liquid discharge conduit 12 via the conduit 46 only.

In this case the pressure of the second pressure medium in the chamber 9 in the housing 1 may be varied by varying the pressure in the discharge conduit 12 by means not illustrated in the drawing.

This embodiment may operate without additional accumulator in the liquid discharge conduit 12.

The pile driver in this embodiment does not include an impact plate in the housing 1.

It is noted, that as an alternative to the embodiments of FIGS. 3 and 3*a* it is further possible that the cylinder 8 at its upper side is closed and the space in the cylinder 8 above the piston 7 communicates via a conduit directly with the chamber 38 in the accumulator 39.

Since for obtaining an acceleration force as constant as possible on the impact weight 2 during the work stroke it is important that the pressure of the second pressure medium in the cylinder 8 varies as least as possible. In this case the chamber 38 in the accumulator 39 preferably should have a relatively great volume.

FIG. 4 shows an embodiment of the pile driver, which for the major part is similar with the embodiment of FIG. 2. The connecting passage 31 in the upper guide ring 6 is however not present in the embodiment according to FIG. 4. To the supply conduit 18, connecting the source of supply 17 with the control slide valve 19 is branched a branch conduit 47, which includes a slide valve 48 and opens in the lower portion 50 of the housing 1 at some distance above the water level 49. Furthermore the chamber 32 and the lower portion 50 of the housing 1 are connected together by a conduit 51. As an alternative there can also be used an internal connection between the chamber 32 and the lower portion 50 of the housing 1.

When the slide valve 48 is moved into the position connecting the branch conduit 47, an overpressure in the lower portion 50 of the housing 1 can be produced by the branch conduit 47 to prevent the water level 49 from rising too high in the housing 1 and from reaching the impact plate 27, which would adversely influence pile driving under water.

The slide valve 48 may be switched, for example mechanically, by means of a level switch (not illustrated), while it is also possible to electrically measure the water level 49 and to electromagnetically actuate the slide valve 48.

Of course as an alternative it is also possible to have the branch conduit 47 opening into the chamber 32, containing the impact weight 2 and in this case the lower portion 50 of the housing 1, as well as the guide device 36 for the pile 30 disposed therebelow also may be kept under overpressure via de conduit 51.

When pile driving under water it is preferred that the control slide valve 19 is disposed in or near the housing 1 of the pile driver at the driving level and in this case the control conduit 23 of the control slide valve 19 will be exposed to the pressure of the surrounding water. In this manner it is possible to automatically maintain the predetermined constant pressure difference between the pressure in the chamber 9 in the housing 1 and the pressure of the surrounding water.

Figure 5:
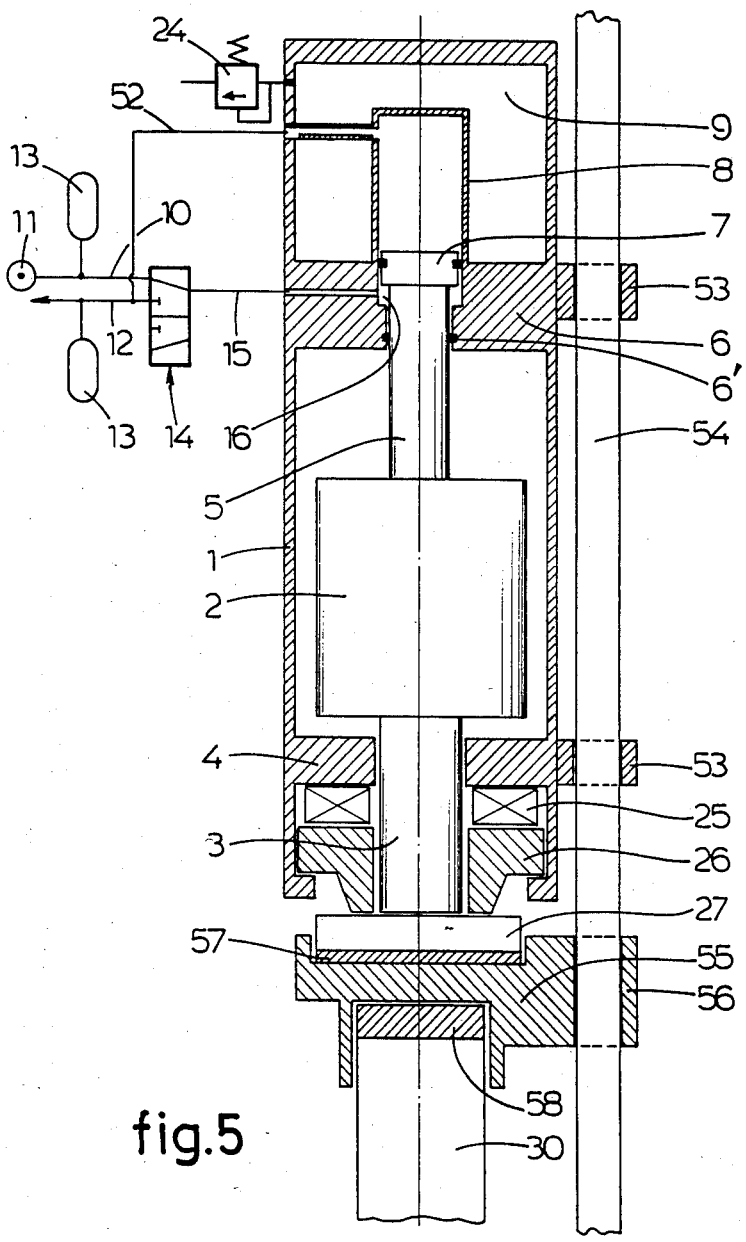
FIG. 5 is a longitudinal section of a fifth embodiment of the pile driver of the invention.

Finally, FIG. 5 shows an embodiment of the pile driver of the invention, wherein the second pressure medium in the cylinder 8 is not gaseous, but is constituted by a liquid, namely the same liquid that is used for moving the impact weight 2.

In this embodiment the cylinder 8 is closed with respect to the chamber 9 in the housing 1 and connected by a connecting passage 52 to the liquid discharge conduit 12 upstream of the control slide valve 14. By varying of the pressure in this liquid discharge conduit 12 the pressure loading the piston 7 in the cylinder 8 at the upper side, can be varied and adapted to the prevailing circumstances.

Furthermore, in the embodiment of FIG. 5 the housing 1 is provided with lugs 53 engaging a guide rod 54. Also the pile bridge cap 55 is connected to the guide rod 54 by means of lugs 56.

In this embodiment a hard cap filler 57 of hard wood or synthetic material is disposed between the impact plate 27 and the pile bridge cap 55, while between the pile bridge cap 55 and the upper end of the pile 30 again a soft cap filler 58 of white firwood or similar material is used.

The invention provides a pile driver, which is adapted for pile driving operations both above water and under water and which in particular offers great advantages when driving under a small angle with the horizontal plane or when working in horizontal direction, for example for carrying a conduit through a ground embankment or for driving nearly horizontal ground anchors.

The invention is not limited to the embodiments illustrated in the drawing, which may be modified in various manners within the scope of the invention.

It is for example possible to provide a particular simple pile driver according to the invention by eliminating the elements 17–23 in the embodiments of FIGS. 1 and 2 and instead thereof providing the housing 1 with a fill opening which opens into the chamber 9 and can be closed by a non-return valve. Through this fill opening the second pressure medium from a source of pressure medium to be connected thereto for filling purposes, may be supplied into the chamber 9 until the required pressure prevails in the chamber 9. Also the discharge of the second pressure medium from the chamber 9 can take place via this fill opening.

In a similar manner in the embodiment of FIG. 5 instead of the connecting passage 52, the housing 1 can be formed with a fill opening which communicates with the cylinder 8 and which can be closed by a non-return valve.

Furthermore the hydraulic pile driver of the invention can also be used for upwardly driving. In this case the impact ram 2 strikes the guide ring 6, then moves downwardly through a small distance and subsequently again strikes the guide ring 6. In upwardly driving the impact ram therefore never strikes the impact plate 27 (FIGS. 1, 2, 4 and 5).

I claim:

1. A hydraulic pile driver comprising:

a housing;

an impact weight mounted within said housing for reciprocal movement comprising a work and an idle stroke and having a circumferential groove;

a cylinder disposed within said housing and having first and second ends;

a first chamber surrounding and being in communication with said cylinder at said first end, said first chamber being pressurized with a gas from a gas source and being closed during the operation of the pile driver;

a second chamber disposed at said second end of said cylinder;

a third chamber within said housing in communication with said first chamber and sealed with respect to the atmosphere and surrounding said impact weight;

a piston disposed in said cylinder and coupled to impact weight; said piston being adapted to move toward or away from said second chamber in accordance with pressure within said second chamber, the volume of said cylinder being much smaller than the volumes of said first chamber and third chamber so that the movement of said piston does not substantially effect the gas pressure within said first chamber; said piston being constructed and arranged to move said impact weight in the work stroke as said piston moves toward said second chamber;

a pressurized liquid source adapted to provide liquid at a higher pressure than the pressure of the gas within said first chambers;

a pressurized liquid supply conduit communicating with said liquid source;

a liquid discharge conduit;

a control slide valve leading to said second chamber and coupled to said liquid supply conduit and said liquid discharge conduit;

a switch disposed in the housing and activated by by said circumferential groove for generating an electrical signal; and electronic control means coupled to said control slide valve to selectively connect said second chamber to said liquid supply and liquid discharge conduits in response to said electrical signal;

whereby said piston moves toward said first end when said second chamber is connected to said liquid supply conduit, and toward said second end when said second chamber is connected to said discharge conduit.

2. The hydraulic pile driver as claimed in claim 1, wherein the gas pressure within said first chamber is adjustable.

3. The hydraulic pile driver of claim 1, further comprising a gas supply conduit, a source of gas and a valve for selectively conducting gas from said source of gas to said first chamber over said gas supply conduit.

4. The hydraulic pile driver as claimed in claim 3 wherein the valve is also connected to a discharge conduit and is adapted to be switched at a predetermined pressure difference between the pressure in the said chamber in the housing and the environmental pressure.

5. The hydraulic pile driver as claimed in claim 1, wherein the valve is located near or in the pile driver.

* * * * *